United States Patent [19]

Warner

[11] Patent Number: 4,958,480

[45] Date of Patent: Sep. 25, 1990

[54] HIGH PROFILE SHRINK PACKAGE

[75] Inventor: John J. Warner, Greer, S.C.

[73] Assignee: W. R. Grace & Co.-Conn., Duncan, S.C.

[21] Appl. No.: 402,273

[22] Filed: Sep. 1, 1989

Related U.S. Application Data

[63] Continuation-in-part of Ser. No. 255,075, Oct. 7, 1988, abandoned.

[51] Int. Cl.[5] ..... B65B 11/52; B65B 11/58; B65B 31/02; B65B 53/02

[52] U.S. Cl. ..... 53/433; 53/442; 53/449; 53/453; 426/124; 426/129; 426/396

[58] Field of Search ..... 53/170, 175, 432, 433, 53/434, 442, 449, 453; 426/124, 129, 396

[56] References Cited

U.S. PATENT DOCUMENTS

| | | | |
|---|---|---|---|
| 2,621,129 | 12/1952 | Ramsbottom et al. | 53/433 X |
| 3,387,427 | 6/1968 | Perdue | 53/453 X |
| 3,674,626 | 7/1972 | Mergy | 53/433 X |
| 4,034,536 | 7/1977 | Mahaffy et al. | 53/433 |
| 4,611,456 | 9/1986 | Gillio-tos et al. | 53/449 X |
| 4,642,239 | 2/1987 | Ferrar et al. | 53/442 X |

*Primary Examiner*—Robert L. Spruill
*Assistant Examiner*—Linda B. Johnson
*Attorney, Agent, or Firm*—John J. Toney; William D. Lee, Jr.; Mark B. Quatt

[57] ABSTRACT

The present invention involves a method of packaging a product including drawing a thermoplastic thermoformable web into a thermoforming mold to form a cavity, inserting the product into the cavity, moving the web and product to a vacuum chamber, placing a tray, upside down, in the chamber on top of the web to define an unsealed package; sealing the tray to the web under vacuum; and shrinking the bottom web.

3 Claims, 3 Drawing Sheets

HIGH PROFILE SHRINK PACKAGE

This application is a continuation-in-part of U.S. Ser. No. 255,075 filed Oct. 7, 1988, now abandoned.

BACKGROUND OF THE INVENTION

The present invention relates to shrink packaging, and more particularly to a shrink package produced from a traY and a thermoformable, shrinkable material.

Many applications for the packaging of food and non-food products, particularly meat products, involve the use of a thermoforming system in which a heat formable material is formed into a cavity and thereafter a product is inserted into the thus formed cavity.

In other types of packaging, a preformed tray is loaded with a product such as a meat product, and thereafter overwrapped by various means including hand wrapping and machine wrapping, to create a complete package.

One problem that has been encountered is how to produce a controlled atmosphere package with low residual oxygen in a tray with a tight lid or overwrap. This problem is especiallY pronounced in the case of high profile products that extend above the edge of the tray.

It has now been discovered that a thermoformable web made from a film or laminate can be deep drawn to form a pocket or cavity. A product such as a meat product can be inserted into the cavity. A tray maY then be sealed in an upside-down arrangement to the top of the thermoformed web in a vacuum chamber with optional gas flushing capabilities. The bottom web is made from a material having some shrinkability even after the thermoforming process. Upon shrinking the bottom web, a tight package with or without the controlled gas atmosphere can be produced.

Both the tray and the bottom web can optionally include a barrier layer or a barrier film applied as a separate step.

SUMMARY OF THE INVENTION

A method of packaging a product comprises drawing a thermoplastic, thermoformable web into a thermoforming die to form a cavity; inserting the product into the cavity; moving the web and product to a vacuum chamber; placing a tray, upside down in the chamber on top of the web to define an unsealed package, the tray having a heat sealable thermoplastic layer adhered thereto along a side of the tray facing the thermoformable web; sealing the tray to the web under vacuum; and shrinking the bottom web.

DESCRIPTION OF THE DRAWINGS

The invention may be further understood by reference to the drawings, in which.

DESCRIPTION OF THE PREFERRED EMBODIMENTS

Figure 1:
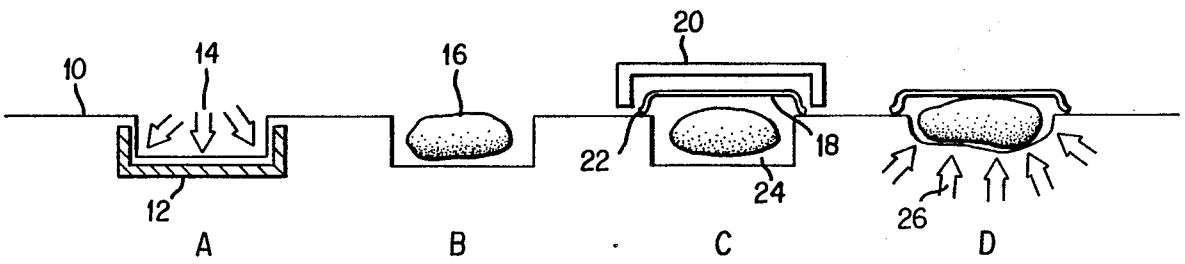
FIG. 1 shows a schematic layout of the steps of the present invention.

Referring to FIG. 1, a bottom web 10 comprising a thermoformable, heat shrinkable film or laminate, is drawn into a thermoforming die 12.

Thermoforming and other similar techniques are well known in the art for packaging food products. Suitable thermoforming methods, for example, include a vacuum forming or plug-assist vacuum forming method. In a vacuum forming method, the first web is heated, such as by a contact heater and a vacuum is applied beneath the web causing the web to be pushed by atmospheric pressure down into a preformed mold. The arrows indicated at 14 of FIG. 1 schematically describe this process.

In a plug-assist vacuum forming method, after the first or forming web has been heated and sealed across a mold cavity, a plug shape similar to the mold shape impinges on the forming web and, upon the application of vacuum, the forming web transfers to the mold surface.

At station B of FIG. 1, a product is placed, such as by manual loading, on the forming web. In some cases automatic or machine loading of the product may be possible. The preferred product for use in connection with this invention is a meat product such as beef, lamb, pork, or poultry.

Referring to station C of FIG. 1, a tray 18 is introduced in an upside down arrangement into a vacuum chamber 20. The tray is vacuum sealed to the periphery 22 of the cavity formed by the thermoformed web 10. The space 24 defined by the outer surface of the food product 16, and inner surface of the thermoformed web 10 can be either vacuumized or gas flushed, or both, depending on the desirability of having controlled or modified gas atmosphere inside the finished package.

The tray 18 is preferably made of a semi-rigid material such as foamed or expanded polystyrene, or CPET (tray substrate) with a heat sealable thermoplastic or cross-linked thermoplastic layer laminated or otherwise adhered to it. This heat sealable layer bonds to the thermoformed web 10 when the tray 18 is vacuum sealed to the periphery 22 of the cavity formed by the thermoformed web. The heat sealable layer can be an ethylene polymer or copolymer such as ethylene vinyl acetate copolymer or ethylene n-butyl acrylate copolymer, as disclosed in copending U.S. Pat. application Ser. No. 115,452 now U.S. Pat. No. 4,847,148 incorporated herein by reference. The heat sealable layer is adhered to the tray substrate at least along the side of the tray facing the product and bottom web 10, and can be adhered to the entire exterior of the tray substrate.

When used alone in conjunction with the polystyrene or CPET tray substrate, the heat sealable layer will also function as a bonding layer for bonding the heat sealable layer to the tray substrate. Alternatively, a separate bonding thermoplastic or cross-linked thermoplastic layer can be included in the overall structure of the tray and will be disposed between the tray substrate and the heat sealable layer.

Still another alternative is the inclusion of additional thermoplastic or cross-linked thermoplastic layers between the heat sealable layer and the bonding layer.

The separate bonding layer preferably has the same or similar composition to that of the heat sealable layer.

Moving to station D, the thermoformed web 10 is shrunk by the use of steam or other shrinking means indicated by the arrows at 26.

As depicted in FIG. 1, the package which results is a trayed product with a tight fitting appearance and a high profile i.e. the top of the food product projects above (when the package is turned right side up) the edge of tray 20.

It is sometimes desirable to add oxygen barrier characteristics to the package. A barrier layer may be included in the structure of the thermoformable web 10, either by coextrusion or extrusion coating or laminating techniques. However, even if the barrier component is built into thermoformed layer 10, the tray 18 must likewise have good oxygen barrier properties to produce a final package with good oxygen barrier characteristics.

One way of providing such a tray is the use of premade barrier trays, such as for example polystyrene or CPET trays, having a coating or adhered lamination of an oxygen barrier material such as saran or vinyl alcohol polymer or copolymer, and the heat sealable layer discussed above.

Barrier trays can also be made by heating a separate barrier web 28 by means of a heater 30, and then passing the barrier web into the vacuum chamber 20 so that the barrier web 28 contacts the interior surface of tray 18. When the barrier web 28 is in place inside the vacuum chamber and inside the interior portion of tray 18, the steps outlined above at stations C and D of FIG. 1 may be accomplished, and will result in a package like that of FIG. 1, but also including a barrier web adhered to the inside of tray 18. In this event, the thermoformed web 10 will be sealed to the tray 18 bY means of the intermediate barrier web 28 which will be firmly adhered to the tray. The barrier web will in such case include a heat sealable layer as the outermost layer of the web. This layer will be sealed to the thermoformed web 10. As described earlier, additional layers including a discrete non-barrier bonding layer can be included in the overall tray structure.

Figure 3:
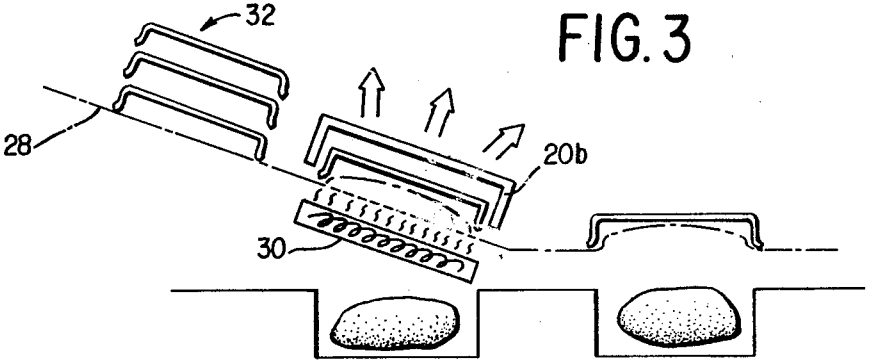
FIG. 3 shows an additional step of applying a barrier film to a tray prior to forming the finished package.

Referring to FIG. 3, an alternate method of including a barrier layer on tray 18 involves the use of a magazine 32 of trays 18 which are carried by a barrier web 28 into the vacuum chamber 20. A heating element 30 softens and heats the barrier web so that it may be drawn by for example differential pressure or vacuumization up against the interior surface of the tray 18 now enclosed within the vacuum chamber 20.

Vacuum chamber **20*b* can be substantially like that of vacuum chamber 20, but will in effect provide a preparation step of adhering a barrier web 28 to a tray 18. Thus, the now prepared tray may be fed through a second vacuum chamber 20, as depicted in FIG. 1** at station C, and the process described above may be performed to produce a heat shrunk barrier trayed package.

Figure 4:
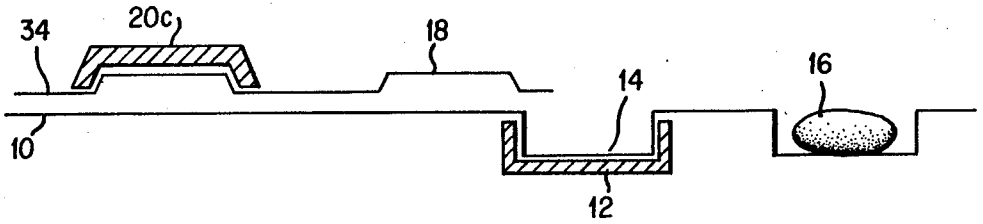
FIG. 4 discloses a tray formed from roll stock and used in connection with the invention.
Figure 2:
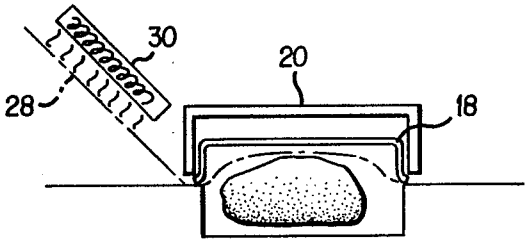
FIG. 2 shows an additional step in accordance with the invention.

Referring lastly to FIG. 4, the tray 18 may in effect be formed from a roll stock 34 which is thermoformable or otherwise formable. As can be seen in FIG. 4, a thermoformed tray is thus formed from roll stock in an upside down configuration in a vacuum chamber **20*c* which may be substantially like those of the previous figures. This roll stock tray formation may occur at a separate thermoforming station from those depicted earlier. In practice, the thus formed trays could be indexed into the chamber of station C (see FIG. 1). For purposes of clarity, the formed trays 18 are depicted in FIG. 4 as being on the same work path as bottom web 10. Both barrier and non-barrier rollstock 34** can be used.

While the invention has been described by reference to specific examples and illustrations, those skilled in the art will readily understand, after review of the specification, that modifications may be made without departing from the sphere and scope of the claims. These modifications are therefore deemed to be within the claims as set forth below.

What is claimed is:

1. A method of packaging a product comprising:

(a) drawing a thermoplastic, thermoformable shrinkable bottom web into a thermoforming die to form a cavity;

(b) inserting the product into the cavity;

(c) moving the thermoformed bottom web and product to a vacuum chamber;

(d) placing a preformed tray, upside down, in the chamber on top of the web to define an unsealed package, the tray having a heat sealable thermoplastic layer adhered thereto along a surface of the tray facing the thermoformable web;

(e) sealing the tray directly to the bottom web under vacuum;

(f) shrinking the bottom web; and (g) turning the packing right side up such that the shrunken bottom web becomes the top of the final package.

2. The method of claim 1 further comprising, between steps d) and e), gas flushing the unsealed package.

3. The method of claim 1 further comprising, between steps c) and d):

(i) preheating a thermoplastic oxygen barrier film; and (ii) adhering the film to the tray in a vacuum chamber.

* * * * *

UNITED STATES PATENT AND TRADEMARK OFFICE

CERTIFICATE OF CORRECTION

PATENT NO. : 4,958,480

DATED : 9-25-90

INVENTOR(S) : John J. Warner

It is certified that error appears in the above-identified patent and that said Letters Patent is hereby corrected as shown below:

In column 4, line 41, delete "packing", substituting therefor --package--

Signed and Sealed this

Seventh Day of July, 1992

*Attest:*

DOUGLAS B. COMER

*Attesting Officer*

*Acting Commissioner of Patents and Trademarks*